US006086226A

United States Patent [19]

Chang

[11] Patent Number: 6,086,226

[45] Date of Patent: Jul. 11, 2000

[54] DECORATED WITH LIGHTING FIXTURE

[76] Inventor: Li-Er Lin Chang, No. 160, Si-Shih Road, Feng Yuan City, Taichung Hsien, Taiwan

[21] Appl. No.: 09/058,278

[22] Filed: Apr. 10, 1998

[51] Int. Cl.[7] ..... F21V 29/00

[52] U.S. Cl. ..... 362/294; 362/147; 416/5

[58] Field of Search ..... 362/96, 294; 416/5

[56] References Cited

U.S. PATENT DOCUMENTS

| | | | |
|---|---|---|---|
| 4,796,166 | 1/1989 | Greenberg | 362/294 |
| 5,404,284 | 4/1995 | Davis | 362/294 |
| 5,440,459 | 8/1995 | Chan | 362/294 |
| 5,454,692 | 10/1995 | Davis | 416/5 |
| 5,658,129 | 8/1997 | Pearce | 416/5 |

*Primary Examiner*—Sandra O'Shea
*Assistant Examiner*—Hargobind S. Sawhney
*Attorney, Agent, or Firm*—Browdy and Neimark

[57] ABSTRACT

A ceiling fan is composed of a fan unit fastened at one end thereof onto a ceiling, a lighting fixture fastened with the fan unit, and a power control device for controlling the power supply to the fan unit and the lighting fixture. The lighting fixture is composed of an auxiliary lamp seat and a main lamp housing. The power control device is fastened at one end thereof with the output shaft of a motor of the fan unit via the auxiliary lamp seat such that the power control device is located inside the main lamp housing which is fastened under the auxiliary lamp seat by a fastening bolt that is engaged with another end of the power control device. The auxiliary lamp seat has an open top, a receiving space and a bottom. The auxiliary lamp seat is fastened between the motor of the fan unit and the power control device such that the motor is located in the receiving space of the auxiliary lamp seat. The auxiliary lamp seat is provided with a plurality of auxiliary lamp holders which are fastened respectively at one end thereof with the bottom of the auxiliary lamp seat.

3 Claims, 3 Drawing Sheets

DECORATED WITH LIGHTING FIXTURE

FIELD OF THE INVENTION

The present invention relates generally to a ceiling fan, and more particularly to a ceiling fan decorated with a lighting fixture.

BACKGROUND OF THE INVENTION

As shown in FIG. 1, a ceiling fan 1 of the prior art is composed of a fastening seat 2, a fastening rod 3, a motor 4, a plurality of blade holders 5 and blades 6, a fan control device 7, a plurality of lamps 8, and a lamp control device 9.

Such a prior art ceiling fan 1 as described above is defective in design in that the combined length (L) of the motor 4, the fan control device 7, the lamps and the lamp control device 9 is excessive, and that the prior art ceiling fan 1 is not suitable for a room having a low ceiling.

An improved version of the prior art ceiling fan is composed of a main lamp housing in which the fan motor is located. The auxiliary lamps are mounted around the top of the main lamp housing. The overall length of the ceiling fan is thus reduced. However, the improvement is made at the expense of operation of the fan blades. In other words, the lighting fixtures of the prior art ceiling fan are prone to interfere with the operation of the fan blades.

SUMMARY OF THE INVENTION

The primary objective of the present invention is to provide a ceiling fan free from the drawbacks of the prior art ceiling fans described above.

In keeping with the principle of the present invention, the foregoing objective of the present invention is attained by a ceiling fan consisting of a fastening rod, a motor, a plurality of fan blades, a control device, and a lighting fixture. The lighting fixture is composed of a main lamp housing in which the control device is located, and an auxiliary lamp seat having a receiving space in which the motor is located. The overall length of the ceiling fan is thus significantly reduced.

DETAILED DESCRIPTION OF THE INVENTION

Figure 1:
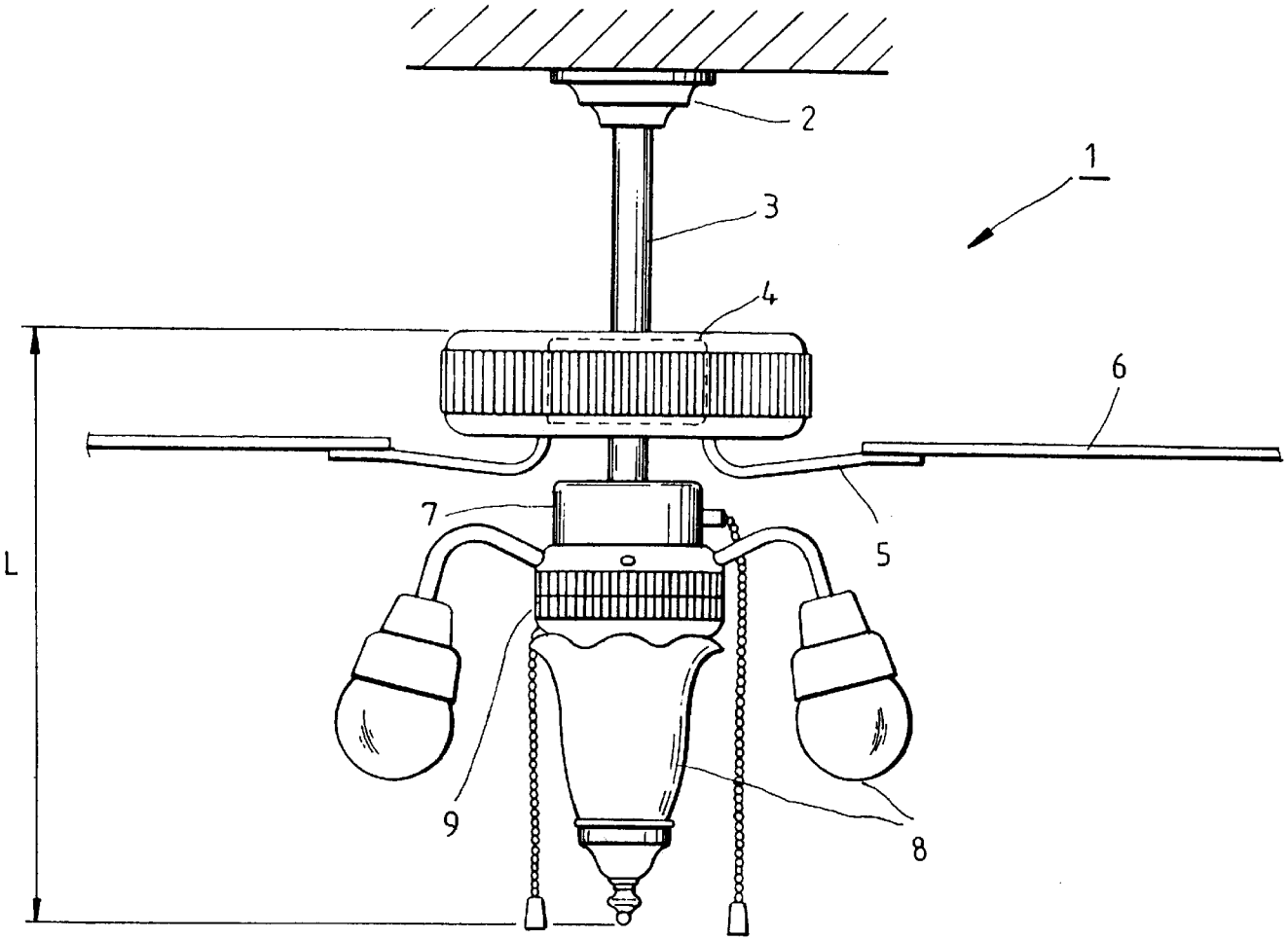
FIG.1 PRIOR ART
FIG. 1 shows a schematic view of a ceiling fan of the prior art.
Figure 2:
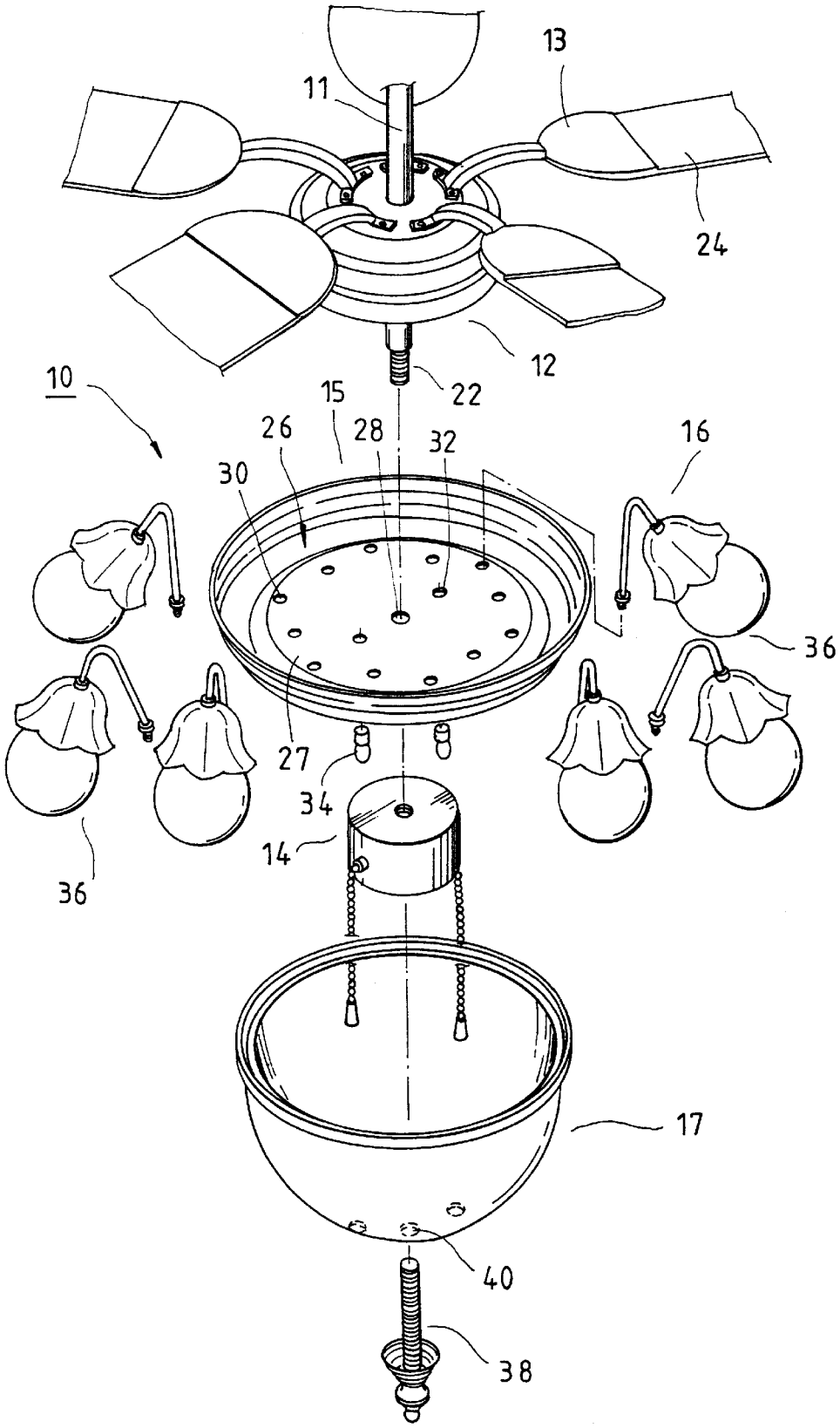
FIG. 2 shows an exploded view of a ceiling fan of the present invention.
Figure 3:
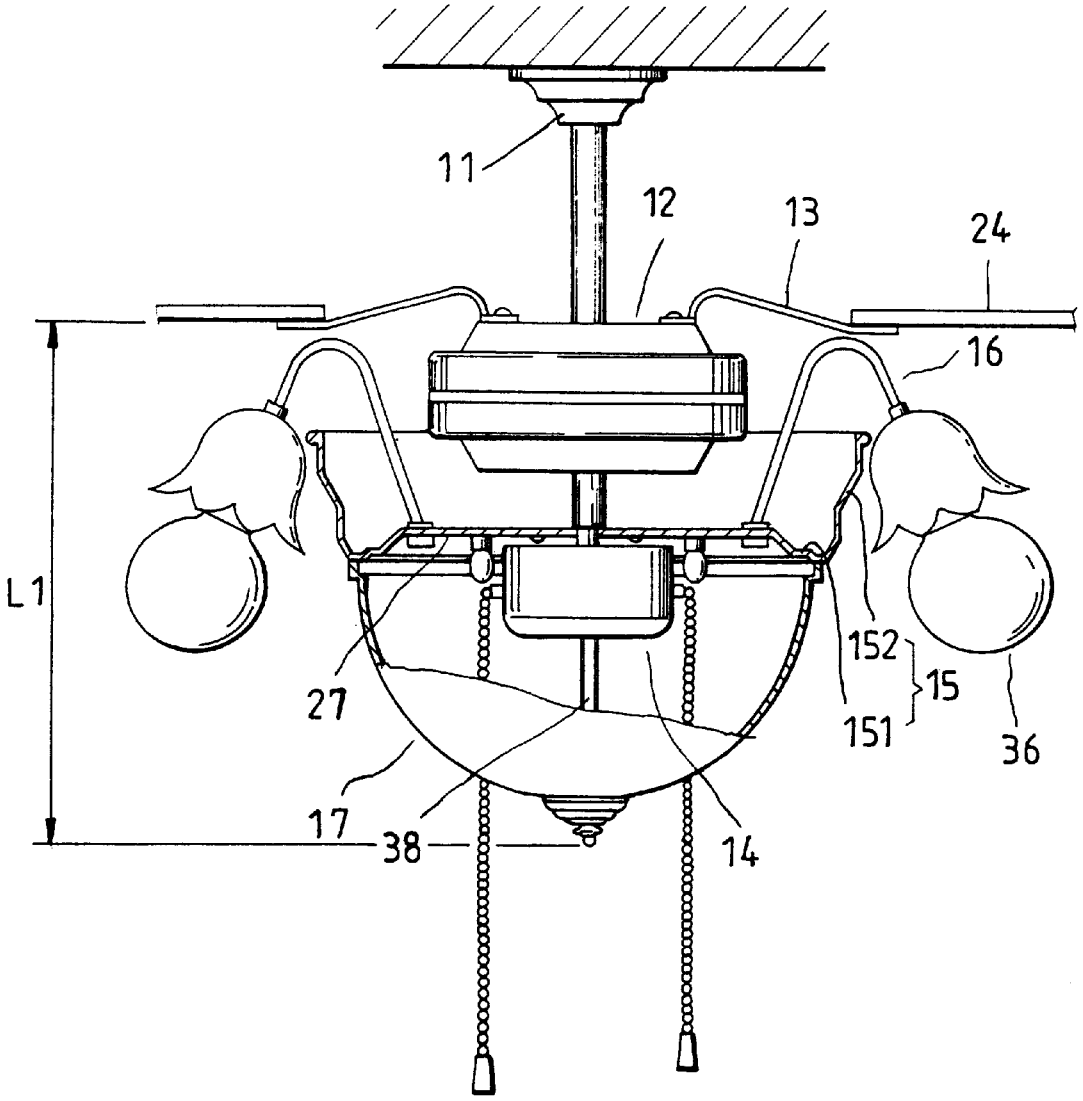
FIG. 3 shows a longitudinal sectional view of the present invention in combination.

As shown in FIGS. 2 and 3, a ceiling fan 10 embodied in the present invention is composed of a fan unit, a lighting fixture and a control device. The fan unit is composed of a fastening rod 11, a motor 12 and a plurality of fan blade holders 13. The lighting fixture consists of an auxiliary lamp seat 15, a plurality of auxiliary lamp holders 16, and a main lamp housing 17. The power source for the fan unit and the lighting fixture is regulated by the power control device 14.

The fan unit is mounted on the fastening rod 11, which is fastened at the top end thereof onto the ceiling of a room and is fastened at the bottom end thereof with a power output shaft 22 of the motor 12. The fan blade holders 13 are fastened respectively at one end thereof with the top of the motor 12, and at another end thereof with a fan blade 24. The control power device 14 is fastened with the power output shaft 22 such that the control device 14 is located inside the main lamp housing 17.

The lighting fixture is fastened with the fan unit such that the auxiliary lamp seat 15 is located between the motor 12 and the power control device 14, and that the main lamp housing 17 is fastened with the power control device 14 by a fastening bolt 38, which is put through a through hole 40 of the housing 17.

The auxiliary lamp seat 15 is of a dishlike construction and is made of a metal material. The auxiliary lamp seat 15 has an open top and a bottom 151 which is provided at the center thereof with a fastening hole 28 via which the power output shaft 22 of the motor 12 is fastened with the power control device 14. The bottom 151 is surrounded by a flat portion 152 for forming a receiving space 26 in which the motor 12 is located. The bottom 151 is further provided with a reinforced portion 27. The reinforced portion 27 is provided with a plurality of locating holes 30. The bottom 151 is further provided with two bulb receiving holes 32 for holding the bulbs 34 of the main lamp unit. The locating holes 30 are intended to locate one end of the auxiliary lamp holders 16. Each of the lamp holders 16 has a bulb 36.

As compared with the prior art ceiling fan, the ceiling fan of the present invention has an overall longitudinal length (L1) which is substantially reduced.

What is claimed is:

1. A ceiling fan to be used with lamp bulbs and mounted on a ceiling of a room, the ceiling fan comprising a fan unit, a lighting fixture, and a power control device for controlling the power supply to the fan unit and the lighting fixture, said fan unit comprising a fastening rod fastened at one end thereof onto the ceiling of the room, a motor fastening with another end of said fastening rod and including a power output shaft fastened therewith, and a plurality of blade holders, which are fastened respectively at one end thereof with said motor and include at another end thereof a respective fan blade fastened therewith;

wherein said lighting fixture comprises an auxiliary lamp seat of a dishlike construction and a main lamp housing, said auxiliary lamp seat including an open top, a receiving space, and a bottom which includes a fastening hole, and a plurality of bulb receiving holes for holding the lamp bulbs in said main lamp housing, said auxiliary lamp seat including a plurality of auxiliary lamp holders which are fastened at one end thereof with said bottom of said auxiliary lamp seat and receive at another end thereof an auxiliary lamp bulb, said auxiliary lamp seat being fastened between said motor and said power control device such that said power output shaft is engaged with said power control device via said fastening hole of said bottom of said auxiliary lamp seat, and that said motor is located in said receiving space of said auxiliary lamp seat, said main lamp housing being fastened under said auxiliary lamp seat such that said main lamp housing contains said power control device, wherein said bottom of said auxiliary lamp seat includes a reinforced portion; and wherein said auxiliary lamp holders are fastened respectively at one end thereof with said reinforced portion.

2. The ceiling fan as defined in claim 1, wherein said auxiliary lamp seat is made of a metal material.

3. The ceiling fan as defined in claim 1, wherein said reinforced portion is provided with a plurality of locating holes for locating said one end of each of said auxiliary lamp holders.

* * * * *